US008961228B2

(12) United States Patent
Jeon

(10) Patent No.: US 8,961,228 B2
(45) Date of Patent: Feb. 24, 2015

(54) ELECTRICAL CONNECTOR HAVING SHIELDED DIFFERENTIAL PAIRS

(75) Inventor: Myoungsoo Jeon, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 303 days.

(21) Appl. No.: 13/408,641

(22) Filed: Feb. 29, 2012

(65) Prior Publication Data

US 2013/0224999 A1 Aug. 29, 2013

(51) Int. Cl.
*H01R 13/648* (2006.01)
*H01R 13/6599* (2011.01)
*H01R 12/50* (2011.01)

(52) U.S. Cl.
CPC ..... *H01R 13/6599* (2013.01); *H01R 23/7073* (2013.01)
USPC ..... 439/607.07

(58) Field of Classification Search
USPC ..... 439/607.03, 607.07, 607.11
See application file for complete search history.

(56) References Cited

U.S. PATENT DOCUMENTS 6,146,202 A * 11/2000 Ramey et al. ..... 439/607.1
6,157,548 A 12/2000 Collins et al.
6,371,813 B2 * 4/2002 Ramey et al. ..... 439/607.05
6,602,095 B2 * 8/2003 Astbury et al. ..... 439/607.07
6,641,438 B1 * 11/2003 Billman ..... 439/607.07
6,786,771 B2 9/2004 Gailus
7,722,401 B2 * 5/2010 Kirk et al. ..... 439/607.07
7,753,731 B2 * 7/2010 Cohen et al. ..... 439/607.09
7,789,676 B2 * 9/2010 Morgan et al. ..... 439/79
8,690,604 B2 * 4/2014 Davis ..... 439/607.07
2011/0193574 A1 * 8/2011 De Boer et al. ..... 324/688

OTHER PUBLICATIONS

Dampening cavity resonance using absorber material, 3 pages, May 2004.

* cited by examiner

*Primary Examiner* — Neil Abrams
*Assistant Examiner* — Travis Chambers

(57) ABSTRACT

An electrical connector including a connector housing having a mating face that is configured to engage a mating connector. The electrical connector also includes a contact module that is held by the connector housing and that includes differential pairs of signal conductors. The contact module also includes dielectric ribs that encase corresponding signal conductors. The dielectric ribs are spaced apart from one another. The contact module also includes guard conductors that extend between and couple to adjacent dielectric ribs. The contact module also includes a conductive layer that is disposed on the dielectric ribs and the guard conductors. The conductive layer is electrically coupled to the guard conductors.

20 Claims, 5 Drawing Sheets

ELECTRICAL CONNECTOR HAVING SHIELDED DIFFERENTIAL PAIRS

BACKGROUND OF THE INVENTION

The subject matter herein relates generally to an electrical connector having a plurality of differential pairs of signal conductors for transmitting data signals.

Electrical connector systems, such as those used in networking and telecommunication systems, utilize receptacle and header connectors to interconnect components of the system, such as a motherboard and daughtercard. However, as speed and performance demands increase, known electrical connectors are proving to be insufficient. For example, signal loss and/or signal degradation is a problem in known electrical systems. There is also a desire to increase the density of signal conductors to increase throughput of the electrical system, without an appreciable increase in size of the electrical connectors. In fact, a decrease in the sizes of the electrical connectors is desired. However, increasing the density of signal conductors and/or reducing the size of the electrical connectors can cause further strains on performance. In addition to the above challenges, certain types of connector configurations, such as right-angle configurations, may also cause problems with the performance and implementation of electrical connectors.

In order to address the above challenges, connector systems have been proposed that are configured to shield differential pairs of signal conductors from each other to reduce interference between the differential pairs. For example, in some connector systems, the electrical connector(s) have plastic housings that are metalized (e.g., copper-plated plastic housing). A metalized plastic housing may include metal fibers or other conductive particles within the plastic material of the housing. However, metalized housings can be costly to manufacture.

A need remains for an electrical connector having improved shielding that meets particular performance demands and that is also manufacturable in a cost effective and reliable manner.

BRIEF DESCRIPTION OF THE INVENTION

In one embodiment, an electrical connector is provided that includes a connector housing having a mating face that is configured to engage a mating connector. The electrical connector also includes a contact module that is held by the connector housing and that includes differential pairs of signal conductors. The contact module also includes dielectric ribs that hold corresponding signal conductors. The dielectric ribs are spaced apart from one another. The contact module also includes guard conductors that extend between and couple to adjacent dielectric ribs. The contact module also includes a conductive layer that is disposed on the dielectric ribs and the guard conductors. The conductive layer is electrically coupled to the guard conductors.

Optionally, at least one of the differential pairs may be completely surrounded by a shielding structure. The shielding structure may include a plurality of the conductive layers. Also optionally, the dielectric ribs may include first dielectric ribs and second dielectric ribs. Each of the first dielectric ribs surrounds a corresponding signal conductor and each of the second dielectric ribs surrounds a corresponding signal conductor. The first dielectric ribs are positioned adjacent to corresponding second dielectric ribs. The signal conductors of each of the adjacent first and second dielectric ribs form a differential pair.

In another embodiment, an electrical connector is provided that includes a leadframe having signal and guard conductors. The electrical connector also includes a dielectric frame having a plurality of dielectric ribs that are substantially coplanar with one another. The dielectric ribs encase the signal conductors. The guard conductors extend between and couple adjacent dielectric ribs. The electrical connector also includes a conductive layer that is disposed on at least two of the dielectric ribs and at least two of the guard conductors. The at least two guard conductors are electrically coupled through the conductive layer.

Optionally, at least two of the guard conductors may be coupled to a common dielectric rib and on opposite sides of at least one signal conductor in the common dielectric rib. Also optionally, the leadframe and the dielectric frame may form a first module sub-assembly. The electrical connector may further include a second module sub-assembly that has a leadframe and a dielectric frame. The first and second module sub-assemblies may be stacked side-by-side to form a contact module.

In another embodiment, an electrical connector is provided that includes first and second module sub-assemblies stacked side-by-side. Each of the first and second module sub-assemblies includes signal and guard conductors and a dielectric frame. The dielectric frame includes dielectric ribs that encase corresponding signal conductors. The guard conductors extend between the dielectric ribs. The electrical connector also includes first and second conductive layers that are disposed on the dielectric frames of the first and second module sub-assemblies. The first conductive layer is deposited on adjacent dielectric ribs of the first module sub-assembly and the guard conductor that extends between said adjacent dielectric ribs. The second conductive layer is deposited on adjacent dielectric ribs of the second module sub-assembly and the guard conductor that extends between said adjacent dielectric ribs.

DETAILED DESCRIPTION OF THE INVENTION

Figure 1:
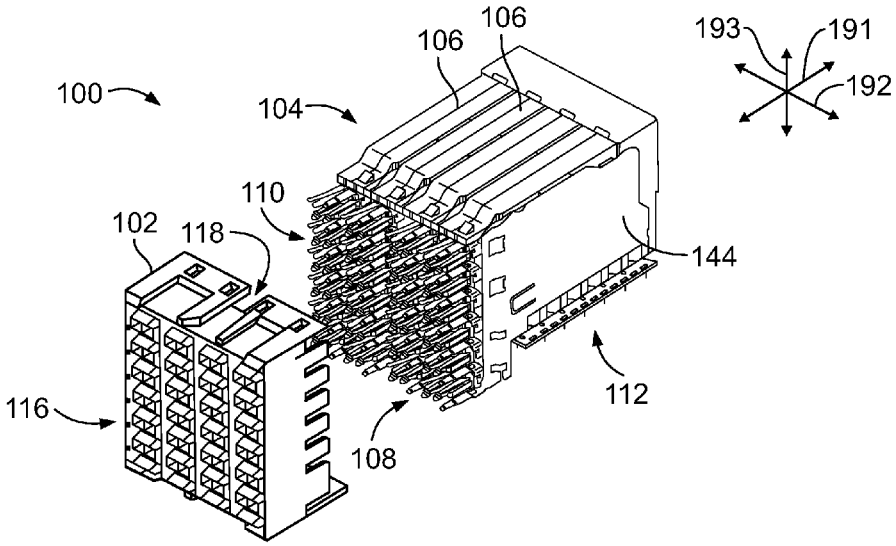
FIG. 1 is a partially exploded view of an electrical connector formed in accordance with one embodiment.

FIG. 1 is a partially exploded view of an electrical connector 100 formed in accordance with one embodiment. The electrical connector is oriented with respect to mutually perpendicular axes 191-193, including a mating axis 191, a lateral axis 192, and an orientation axis 193. In the illustrated embodiment, the electrical connector 100 includes a connector housing 102 and a module assembly 104 that is configured to be coupled to and held by the connector housing 102. The module assembly 104 may include one or more contact modules 106. For example, a plurality of the contact modules 106 may be stacked side-by-side and held by the connector housing 102. Each of the contact modules 106 includes a terminal end or side 108 where a plurality of exposed conductor beams 110 are located, and a mounting end or side 112 where a plurality of exposed conductor tails 114 (shown in FIG. 2) are located.

In the illustrated embodiment, the terminal end 108 and the mounting end 112 are oriented perpendicular to each other such that the terminal end 108 faces in a mating direction along the mating axis 191 and the mounting end 112 faces in a mounting direction along the orientation axis 193. Accordingly, the electrical connector 100 may be characterized as a right-angle connector. However, in alternative embodiments, the electrical connector 100 may be a vertical connector in which the terminal and mounting ends 108, 112 face in opposite directions along the mating axis 191.

The connector housing 102 includes a mating face 116 and a loading end or side 118. The loading end 118 is configured to engage the terminal ends 108 of the contact modules 106 when the electrical connector 100 is fully constructed. The mating face 116 may also be considered the mating face of the electrical connector 100, and the mounting ends 112 may also be considered, collectively, the mounting end or side of the electrical connector 100.

In the illustrated embodiment, the connector housing 102 is a separate component that is coupled to the terminal ends 108 of the contact modules 106. However, in alternative embodiments, the connector housing 102 may completely surround the module assembly 104. The connector housing 102 can also be an integral part of the module assembly 104 in other embodiments. Moreover, the connector housing 102 is a single, molded element that includes dielectric material in the illustrated embodiment. In alternative embodiments, the connector housing 102 may include a plurality of elements that are combined together. For example, the connector housing 102 may include a dielectric element and a shield that is coupled to the dielectric element.

In particular embodiments, the electrical connector 100 is configured to be used in a backplane connector system in which two orthogonal circuit boards are interconnected to each other through the connector system. For example, the electrical connector 100 is configured to be mounted to a first circuit board and the mating face 116 is configured to engage a mating connector. The mating connector may be coupled to a second circuit board. In an exemplary embodiment, the electrical connector 100 is a receptacle connector and the mating connector is a header connector of a high-speed differential connector system. For example, the electrical connector 100 may be similar to a STRADA Whisper® connector developed by Tyco Electronics. In some embodiments, the high-speed signals are transmitted at 25 Gps or more. Although the electrical connector 100 is described with particular reference to high speed, differential-type systems, it is understood that embodiments described herein may be applicable to other types of electrical connectors and, in particular, electrical connectors that include differential pairs.

Figure 2:
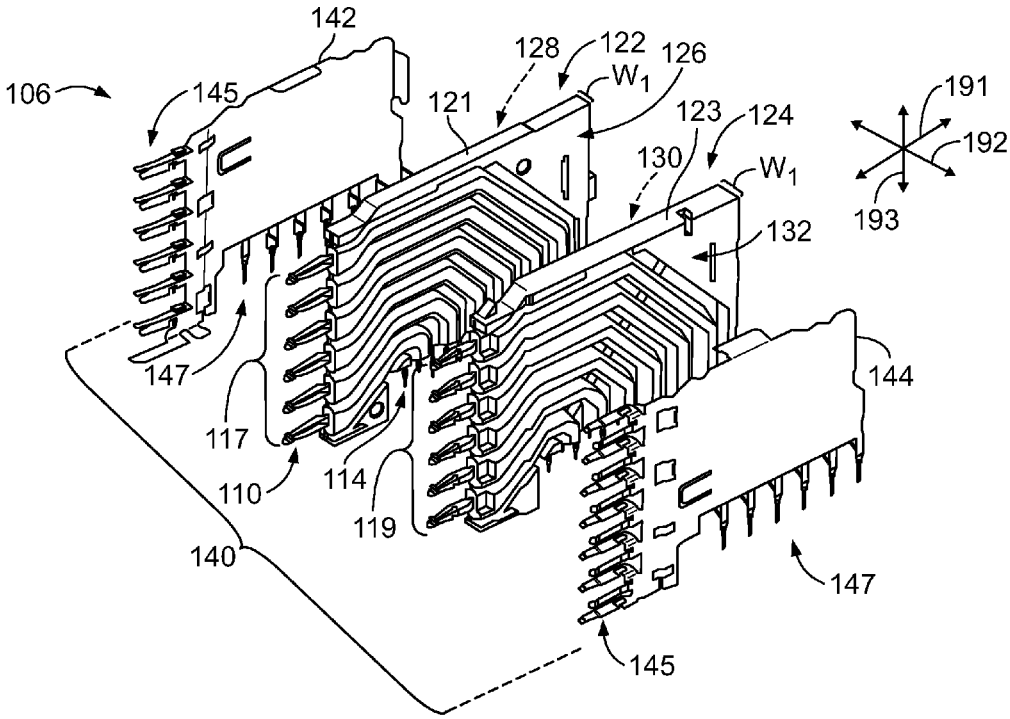
FIG. 2 is an exploded perspective view of a contact module that may be used with the electrical connector of FIG. 1.

FIG. 2 is an exploded perspective view of one exemplary contact module 106. In some embodiments, the contact module 106 includes first and second module sub-assemblies 122, 124 and a shield assembly 140. The first and second module sub-assemblies 122, 124 include respective lead frames 117, 119 and respective dielectric frames 121, 123. The lead frames 117, 119 may be similar to the lead frame 202 (shown in FIG. 3) and have an arrangement of signal and guard conductors that extend along a common plane. In the illustrated embodiment, each of the dielectric frames 121, 123 holds only one lead frame. However, in other embodiments, a single dielectric frame may hold a plurality of lead frames. For example, a single dielectric frame may be formed around two adjacent lead frames.

As shown, the module sub-assemblies 122, 124 may have a rectangular, card-like shape. The dielectric frames 121, 123 have a width $W_1$ measured along the lateral axis 192 that is significantly smaller than other dimensions (e.g., length and height) of the dielectric frames 121, 123. (For reference, the mating axis 191 and the orientation axis 193 are also shown.) The module sub-assemblies 122, 124 are configured to be stacked side-by-side with respect to each other. As shown, the dielectric frame 121 of the module sub-assembly 122 includes inner and outer sides 126, 128, and the dielectric frame 123 of the module sub-assembly 124 includes inner and outer sides 130, 132. When the module sub-assemblies 122, 124 are coupled together, the inner sides 126, 130 engage each other. The outer sides 128, 132 face away from each other along the lateral axis 192.

In the illustrated embodiment, the shield assembly 140 includes a pair of module shields 142, 144. Each of the module shields 142, 144 includes beam shields 145 and tail shields 147. The beam shields 145 are configured to at least partially surround the conductor beams 110, and the tail shields 147 are configured to at least partially surround the conductor tails 114. The module shield 142 engages the module sub-assembly 122 and extends along the outer side 128. The module shield 144 engages the module sub-assembly 124 and extends along the outer side 132. The module shields 142, 144 may be stamped-and-formed from sheet metal. Alternatively, the module shields 142, 144 may include a plurality of interconnected components.

In the illustrated embodiment, the components of the contact module 106 are sandwiched together with the module sub-assemblies 122, 124 coupled to each other between the module shields 142, 144. However, in some embodiments, at least some of the contact modules 106 of the electrical connector 100 (FIG. 1) include only one module shield. For example, the first three contact modules 106 of FIG. 1 (when viewed from the lower right side of FIG. 1) may have only the module shield 144. The last contact module 106 may have both of the module shields 142, 144.

Figure 3:
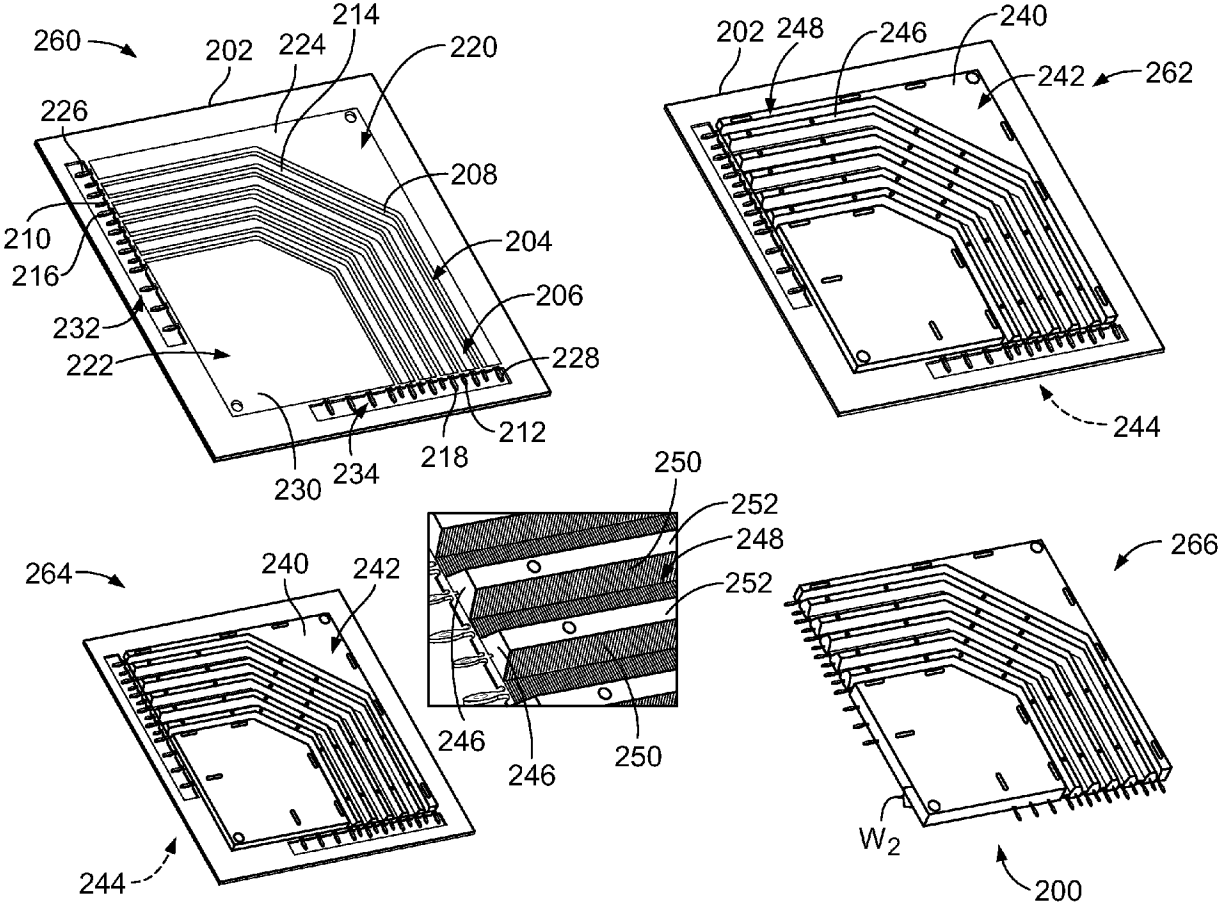
FIG. 3 illustrates various stages during the manufacture of a module sub-assembly of a contact module in accordance with one embodiment.

FIG. 3 illustrates different stages 260, 262, 264, and 266 during the manufacture of a module sub-assembly 200 that may be used to construct a contact module in accordance with one embodiment. The first and second module sub-assemblies 122, 124 (FIG. 2) may be manufactured in the same or similar manner. At stage 260, a lead frame 202 is provided. The lead frame 202 may be formed from a continuous sheet of conductive material (e.g., copper) that is etched to define various structures including signal and guard conductors 204, 206.

The signal conductors 204 include elongated strips 208 of the sheet material. The elongated strips 208 extend between opposite conductor tails 210, 212. The guard conductors 206 also include elongated strips 214 that extend between opposite conductor tails 216, 218. The conductor tails 210, 212, 216, 218 may be compliant pins, such as eye-of-needle pins, that are configured to mechanically and electrically engage other conductive elements. The conductor tails 210, 212, 216, 218 may have other shapes. As shown, the elongated strips 208, 214 are spaced apart from each other. The elongated strips 208, 214 have a plurality of bends along paths of the signal and guard conductors. In an exemplary embodiment, the elongated strips 208, 214 may take similar paths between the respective conductor tails such that the elongated strips 208, 214 extend substantially parallel to each other throughout the lead frame 202. In other embodiments, the elongated strips 208, 214 may jog or turn in different directions with respect to each other in order to achieve a desired electrical performance.

As shown, the lead frame 202 may also be etched to define ground shields 220, 222. The ground shield 220 has a planar body 224 that extends between opposite conductor tails 226, 228, and the ground shield 222 has a planar body 230 that extends between opposite conductor tails 232, 234. In an exemplary embodiment, the various structures of the lead frame 202, including the signal and guard conductors 204, 206 and the ground shields 220, 222, extend along a common plane.

In the illustrated embodiment, the lead frame 202 is etched to define the above structures. However, in other embodiments, the lead frame 202 may be formed in other manners. For example, at least portions of the lead frame 202 may be stamped and shaped.

At stage 262, a dielectric frame 240 is formed around the lead frame 202. By way of one example, portions of the lead frame 202 may be positioned within corresponding mold cavities of an assembly mold (not shown). A dielectric material may be injected into the mold cavities and allowed to solidify around the lead frame 202 to form the shape shown in FIG. 3. Like the dielectric frames 121, 123 (FIG. 2), the dielectric frame 240 has a rectangular, card-like shape that includes a width $W_2$ (shown with respect to stage 266) that is significantly smaller than other dimensions of the dielectric frame 240. As shown at stage 262, the dielectric frame 240 includes first and second sides 242, 244. The first side 242 may correspond to the outer side of the resulting dielectric frame, such as the outer side 132 shown in FIG. 2. The second side 244 may correspond to the inner side of the resulting dielectric frame, such as the inner side 130 shown in FIG. 2.

The dielectric frame 240 includes a series of dielectric ribs 246 that are spaced apart from each other and separated by gaps (or open channels) 248. In an exemplary embodiment, the dielectric ribs 246 are formed around corresponding signal conductors 204 to encase the corresponding signal conductors 204. However, the dielectric ribs 246 are formed only partially around the guard conductors 206 such that portions of the guard conductors 206 are exposed to the ambient environment after stage 262. In such embodiments, the gaps 248 after stage 262 are defined by adjacent dielectric ribs 246 and an exposed portion of a corresponding guard conductor 206 that extends between and joins the adjacent dielectric ribs 246. Although not shown, the dielectric frame 240 may also include bridge elements that extend across the gaps 248 and join adjacent dielectric ribs 246. Such bridge elements may extend over the guard conductors 206.

At stage 264, the dielectric frame 240 has one or more conductive layers 250 disposed (e.g., deposited) on the dielectric ribs 246 and the guard conductors 206. A portion of the module sub-assembly 200 at stage 264 is enlarged. The conductive layers 250 may be disposed on exposed surfaces in various manners. In particular embodiments, the conductive layers 250 are deposited through an ink-printing process or through an over-molding process. The resulting conductive layers 250 may be relatively thin compared to the dielectric frame 240.

In an ink-printing process, the conductive ink may be applied to the dielectric ribs 246 and the guard conductors 206 in a similar manner as conventional inkjet printers apply ink to paper. The composition of the conductive ink may include a liquid vehicle (e.g., water or an organic solvent) and also conductive elements that are dispersed or dissolved within the liquid vehicle. The liquid vehicle allows the conductive ink to be printed in a similar manner as performed by conventional inkjet printers. Stabilizing agents (e.g., a polymeric material) may also be used in the conductive ink. The conductive elements in the liquid vehicle may be nanoparticles or dissolved metal precursors of highly conductive metals, such as the metals Ag, Cu, Al, or Au.

After the conductive ink has been printed to the module sub-assembly 200 (i.e., applied to the surfaces of the dielectric frame 240 and the guard conductors 206), the conductive ink may be cured using a sintering process. In particular embodiments, the conductive layer 250 and the guard conductors 206 have substantially different electrical conductivities. For example, although the conductive layer 250 is conductive relative to the dielectric frame 240, the conductive layer 250 may have a relatively low electrical conductivity compared to the material of the signal and guard conductors. For example, the signal and guard conductors 204, 206 may have an electrical conductivity of $7.50\times10^6$ Siemens per meter (S/m). The conductive layer 250 may have an electrical conductivity of $1.00\times10^4$ S/m or less. In some embodiments, the signal and guard conductors 204, 206 may have an electrical conductivity that is at least a 50 times greater or, more particularly, at least 100 times greater than the electrical conductivity of the conductive layer 240. In particular embodiments, the ink-printed conductive layer 250 has a thickness that is less than about 0.1 mm and, in more particular embodiments, less than about 0.01 mm.

Alternatively, in an over-molding process, the dielectric frame 240 may be held by an overmold apparatus that includes mold cavities. A polymer material having conductive elements therein may be injected into the mold cavities and solidify around selected portions of the dielectric frame 240. The over-molded conductive layer 250 may also have a relatively low electrical conductivity compared to the material of the signal and guard conductors. In particular embodiments, a thickness of the over-molded conductive layer 250 may be less than about 0.3 mm.

In some embodiments, the conductive layer 250 is selectively deposited or patterned onto the module sub-assembly 200. For instance, as shown in FIG. 3, surfaces of the adjacent dielectric ribs 246 that define the gaps 248 are deposited with the conductive layer 250. However, exposed platform surfaces 252 of the dielectric ribs 246 extend between the gaps 248. The platform surfaces 252 do not have a corresponding conductive layer 250 deposited thereon.

It should be noted that FIG. 3 only shows the first side 242 having a conductive layer. In an exemplary embodiment, the second side 244 may also have a conductive layer that is similar to the conductive layer 250. In such embodiments, the conductive layer 250 may be selectively patterned along the dielectric frame 240 such that the gaps 248 have the conductive layer 250 disposed thereon, but the platform surfaces 252 do not have a conductive layer disposed thereon. Alternatively, the conductive layer may be disposed in the gaps 248 and also on the platform surfaces 252 like the conductive layer 351A shown in FIG. 5. After stage 264 is completed, extraneous portions of the lead frame 202 may be removed at stage 266. The extraneous portions may be removed by stamping or etching. Accordingly, the module sub-assembly 200 includes the lead frame 202, the dielectric frame 240, and the conductive layer(s) 250.

Figure 4:
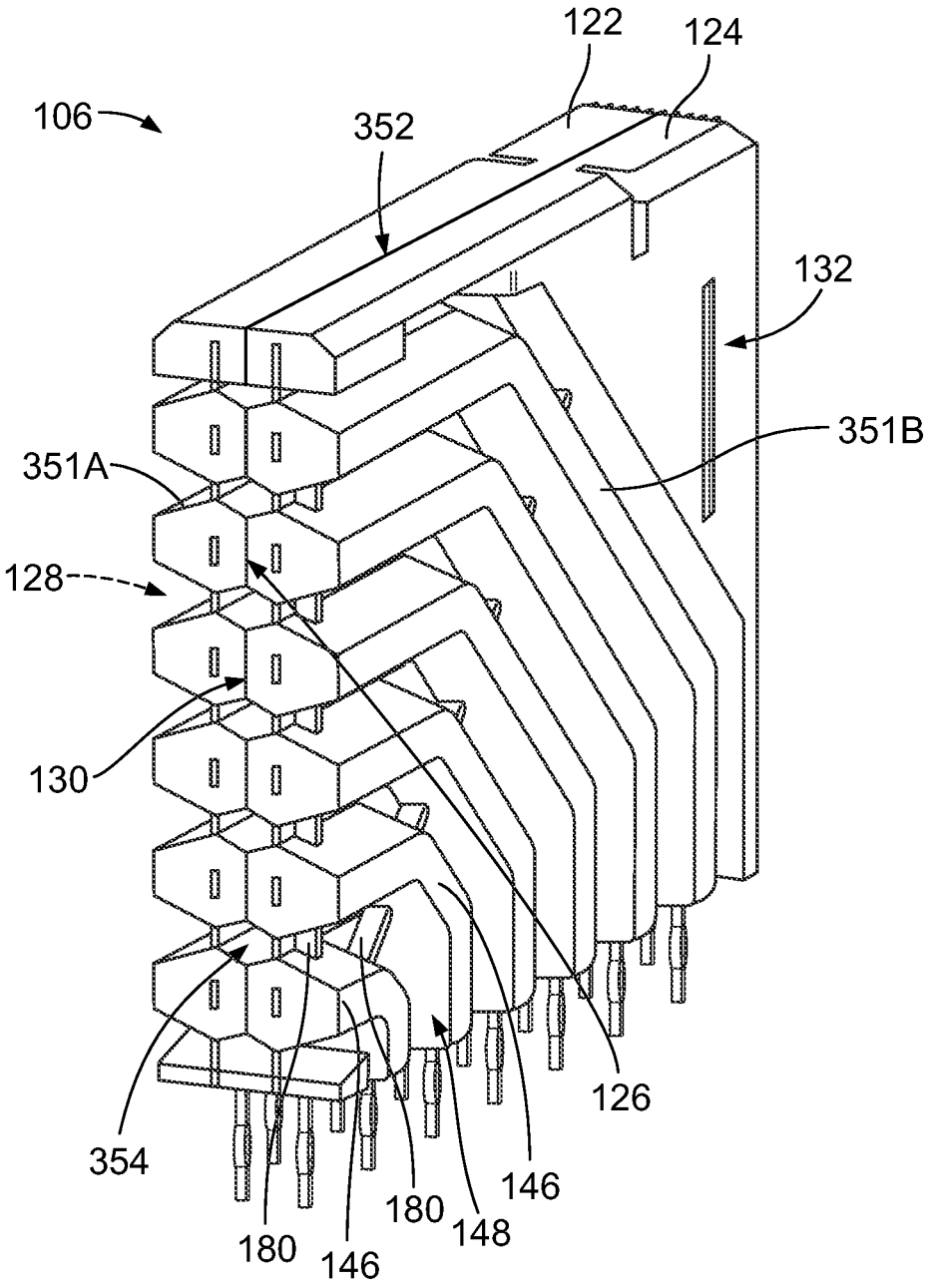
FIG. 4 shows a perspective view of a cross-section of the contact module of FIG. 2.

FIG. 4 shows a perspective view of a cross-section of the contact module 106. For illustrative purposes, the modules shields 142, 144 (FIG. 2) are not shown in FIG. 4. As described above, the module sub-assemblies 122, 124 may be manufactured in the same or similar manner as the module sub-assembly 200 (FIG. 3). After the module sub-assemblies 122, 124 are manufactured, the module sub-assemblies 122, 124 may be coupled together along the inner sides 126, 130 at an interface 352. In some embodiments, an adhesive may be used to facilitate coupling the module sub-assemblies 122, 124 together. The module sub-assemblies 122, 124 may also include structural features (not shown) that form interference fits with each other to hold the module sub-assemblies 122, 124 together. In some embodiments, the module shields 142, 144 may also facilitate holding the module sub-assemblies 122, 124 affixed to each other to form the contact module 106.

The module sub-assemblies 122, 124 have respective outer conductive layers 351A, 351B on the outer sides 128, 132, and respective inner conductive layers 350A, 350B (shown in FIG. 5) on the inner sides 126, 130. In an exemplary embodiment, the outer conductive layers 351A, 351B extend continuously over the dielectric ribs 146 and guard conductors 306A, 306B (shown in FIG. 5) of the respective module sub-assembly. When the module sub-assemblies 122, 124 are coupled together as shown in FIG. 4, interior channels 354 are defined by the inner conductive layers 350A, 350B of the module sub-assemblies 122, 124. The interior channels 354 may extend from the terminal end 108 (FIG. 1) to the mounting end 112 (FIG. 1). In some embodiments, the module sub-assemblies 122, 124 may include bridge elements 180 that extend across gaps 148 between adjacent dielectric ribs 146 of the corresponding module sub-assembly. The bridge elements 180 may provide additional structural support to the module sub-assemblies 122, 124.

Figure 5:
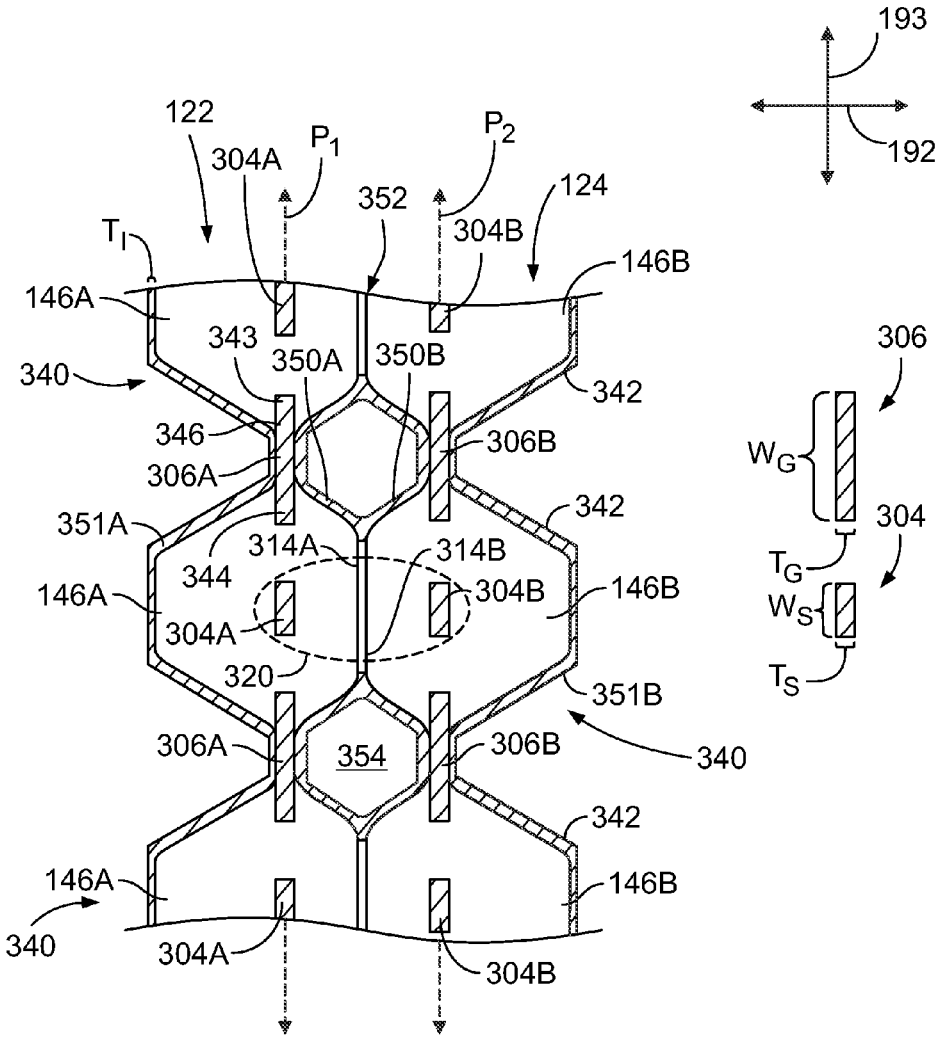
FIG. 5 shows an enlarged cross-section of the contact module illustrating various features in greater detail.

FIG. 5 shows an enlarged cross-section of a portion of the contact module 106 (FIG. 1) after the module sub-assemblies 122, 124 have been coupled together. In the illustrated embodiment, the module sub-assembly 122 includes corresponding guard conductors 306A, signal conductors 304A, dielectric ribs 146A, the outer conductive layer 351A, and the inner conductive layers 350A. The module sub-assembly 124 includes corresponding guard conductors 306B, signal conductors 304B, dielectric ribs 146B, the outer conductive layer 351B, and inner conductive layers 350B. As will be described in greater detail below, the above features of the module assemblies 122, 124 are dimensioned with respect to one another to achieve a target electrical performance. In particular, the above features may be configured to reduce crosstalk between differential pairs.

In an exemplary embodiment, the dielectric ribs 146A of the module sub-assembly 122 are aligned with one another along the orientation axis 193. The guard conductors 306A and signal conductors 304A are also aligned with one another along the orientation axis 193. In a similar manner, the dielectric ribs 146B of the module sub-assembly 124 are aligned with one another along the orientation axis 193, and the guard conductors 306B and signal conductors 304B are aligned with one another as well. More specifically, the guard conductors 306A and the signal conductors 304A may extend within a common plane $P_1$ and the guard conductors 306B and the signal conductors 304B may extend within a common plane $P_2$. The planes $P_1$ and $P_2$ extend parallel to each other and the orientation axis 193.

When the module sub-assemblies 122, 124 are coupled together, the dielectric ribs 146A engage with corresponding dielectric ribs 146B. For instance, the dielectric ribs 146A include inner platform surfaces 314A, and the dielectric ribs 146B include inner platform surfaces 314B. The inner platform surfaces 314A, 314B engage each other along the interface 352. As shown, portions of the inner platform surfaces 314A, 314B are not coated by the conductive layers 350A, 350B.

The guard conductors 306A, 306B provide electrical ground or return paths for the electrical connector 100 (FIG. 1). In the illustrated embodiment, each of the guard conductors 306A is positioned laterally adjacent to a guard conductor 306B. Laterally adjacent guard conductors 306A, 306B may be described as associated guard conductors. The associated guard conductors 306A, 306B directly oppose each other along the lateral axis 192 and have one of the interior channels 354 located therebetween. The interior channels 354 are defined between conductive layers 350A, 350B. More specifically, for each interior channel 354, the conductive layer 350A is deposited on the guard conductor 306A and adjacent dielectric ribs 146A, and the conductive layer 350B is deposited on the guard conductor 306B and adjacent dielectric ribs 146B. In the illustrated embodiment, the interior channel 354 has a cross-section that is shaped similar to a rounded hexagon.

Likewise, the signal conductors 304A are aligned with the signal conductors 304B along the lateral axis 192 such that the signal conductors 304A directly oppose the signal conductors 304B. Aligned signal conductors 304A and 304B may also be described as being laterally adjacent. However, interfacing platform surfaces 314A, 314B of the dielectric ribs 146A, 146B have portions which are not coated by the conductive layers 350A, 350B. As such, the signal conductors 304A and 304B are not separated by a conductive material or layer. Laterally adjacent signal conductors 304A, 304B that are not separated by a conductive material may form a differential pair 320.

In some embodiments, each of the guard conductors 306A is partially encased by adjacent dielectric ribs 146A, and each of the guard conductors 306B is partially encased by adjacent dielectric ribs 146B. For example, with respect to one of the guard conductors 306A, the guard conductor 306A includes opposite end portions 343, 344 and a mid-portion 346 that extends between the end portions 343, 344. The end portions 343, 344 are encased by the dielectric material of adjacent dielectric ribs 146A. The mid-portion 346 is not encased by a dielectric material and, as such, the mid-portion 346 has the inner and outer conductive layers 350A, 351A deposited directly thereon. The conductive layers 350A, 351A are electrically coupled to the guard conductor 306A by direct physical attachment thereto. In some embodiments, the outer conductive layer 351A extends continuously from one guard conductor 306A to another guard conductor 306A such that the two guard conductors 306A are electrically coupled to each other by a direct physical connection through the conductive layer 351A. In particular embodiments, the inner conductive layers 350A, 350B engage each other thereby electrically coupling the associated guard conductors 306A, 306B.

FIG. 5 illustrates cross-sections of the guard conductors 306 and the signal conductors 304. The guard and signal conductors 306, 304 may be dimensioned to achieve a predetermined or target electrical performance. In an exemplary embodiment, the dimensions of the guard and signal conductors 306, 304 are uniform substantially throughout the paths between the respective conductor tails. However, in other embodiments, the dimensions of the guard and signal conductors 306, 304 may vary to achieve the target electrical performance.

As shown in FIG. 5, the guard conductors 306 have a width $W_G$ measured along the orientation axis 193 and a thickness $T_G$ measured along the lateral axis 192. The signal conductors 304 also have a width $W_S$ and a thickness $T_S$. In an exemplary embodiment, the width $W_G$ is greater than the width $W_S$. For example, the width $W_G$ may be at least twice the size of the width $W_S$. However, the width $W_G$ can be smaller than the width $W_S$ in other embodiments. The thicknesses $T_G$ and $T_S$ are substantially equal but may have different sizes in other embodiments.

In the illustrated embodiment, each of the dielectric ribs 146A, 146B may hold a corresponding one signal conductor 304A, 304B, respectively. The signal conductors 304A, 304B may be proximate to corresponding geometric centers of the cross-section of the respective dielectric ribs 146A, 146B.

In an exemplary embodiment, the signal and guard conductors 304A, 306A of the module sub-assembly 122 may alternate with respect to each other such that there is a substantially 1:1 ratio of the signal and guard conductors 304A, 306A. However, in alternative embodiments, there may be different ratios. For instance, the ratio of signal to guard conductors 304A, 306A may be substantially 2:1 or substantially 1:2 in other embodiments. Also shown, at least two of the guard conductors 306A (or 306B) may be coupled to a common dielectric rib 146A (or 146B) and be disposed on respective opposite sides of at least one signal conductor 304A (or 304B) in the common dielectric rib.

Accordingly, each differential pair 320 of signal conductors 304A, 304B may be surrounded by a combination of conductive elements that shield the differential pair 320 from crosstalk generated by adjacent differential pairs 320. More specifically, each of the differential pairs 320 may be surrounded by guard conductors 306A, 306B and conductive layers 350A, 351A, 350B, and 351B. In some embodiments, the guard conductors 306A, 306B are formed from a guard material, and the conductive layers 350A, 351A, 350B, and 351B are formed from a layer material which has lower electrical conductivity than the guard material as described above. Nonetheless, the guard conductors 306A, 306B and the conductive layers 350A, 351A, 350B, and 351B operate in conjunction with one another to effectively shield the differential pairs 320. In the illustrated embodiment of FIG. 5, the conductive layers 350A, 351A, 350B, and 351B are ink-printed as discussed above. The conductive layers 350A, 351A, 350B, and 351B may have a thickness $T_1$ that is less than about 0.1 mm.

In some embodiments, the structure shown in FIG. 5 may be characterized as a plurality of twin coaxial transmission lines 340. More specifically, each of the transmission lines 340 may be formed from one differential pair 320, the dielectric material that holds the one differential pair 320 (e.g., the dielectric ribs 146A, 146B), and a shielding structure 342 of conductive material that surrounds the one differential pair 320 (e.g., the conductive layers 350A, 351A, 350B, and 351B). FIG. 5 shows three such transmission lines 340. As shown, the shielding structures 342 of adjacent transmission lines 340 are electrically coupled to each other through the guard conductors 306A, 306B. In alternative embodiments, only one guard conductor electrically couples the shielding structures 342. In alternative embodiments, the dielectric material is one continuous piece of material. For example, there may be only one dielectric rib that holds the differential pair 320 instead of two dielectric ribs 146A, 146B that each hold one signal conductor.

Figure 6:
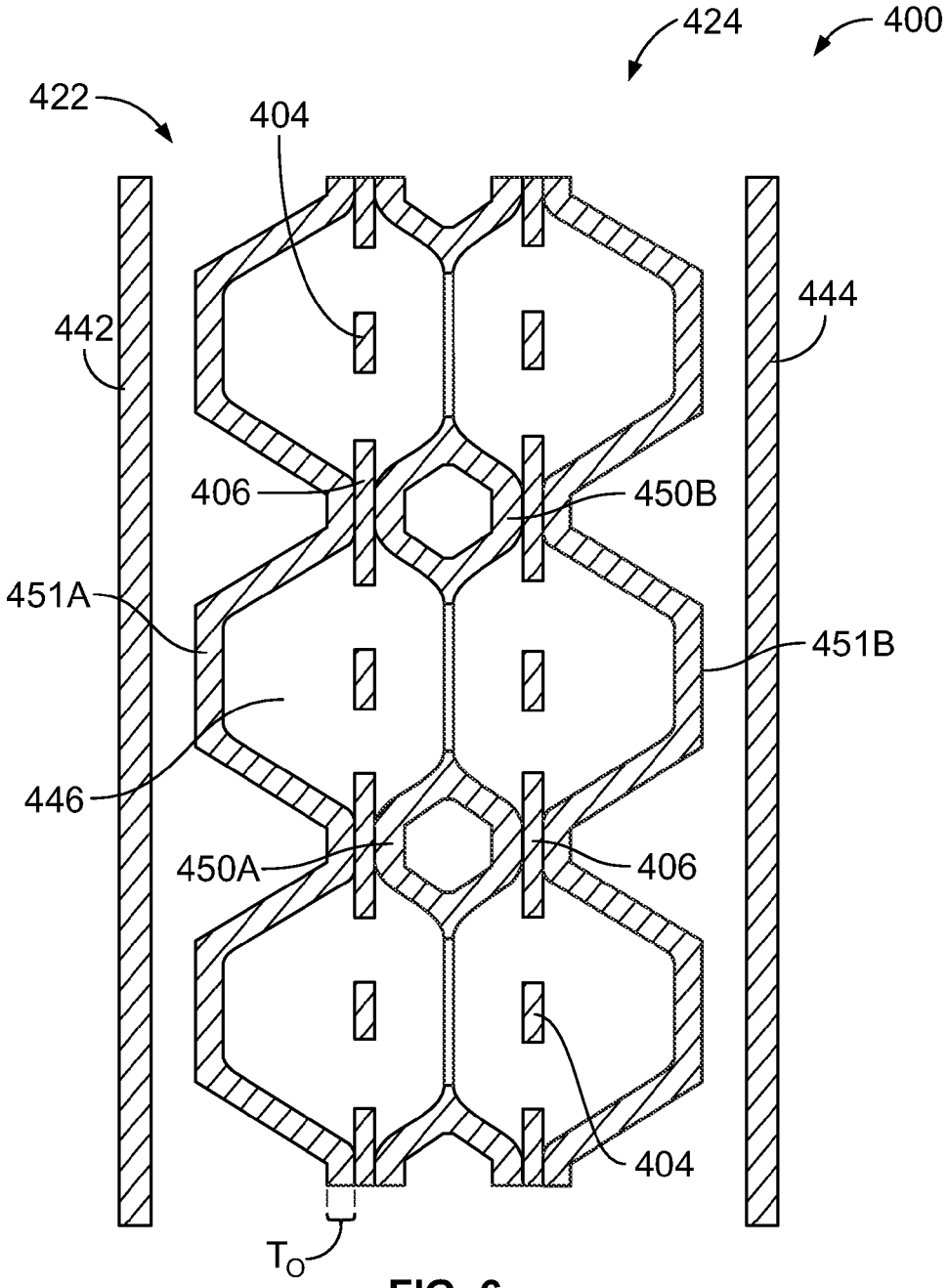
FIG. 6 shows an enlarged cross-section of a contact module according to one embodiment.

FIG. 6 shows an enlarged cross-section of a contact module 400 formed in accordance with one embodiment. The contact module 400 may have structure which is similar to that of the contact module 106 (FIG. 1). For example, the contact module 400 includes first and second module sub-assemblies 422, 424 that are located between first and second module shields 442, 444. The first and second module sub-assemblies 422, 424 have a similar arrangement of dielectric ribs 446, guard conductors 406, and signal conductors 404 as the contact module 106. However, the contact module 400 may include conductive layers 450A, 451A, 450B, and 451B that are different than the conductive layers 350A, 351A, 350B, and 351B (FIG. 5). In particular, the conductive layers 450A, 451A, 450B, and 451B are formed through an overmolding process. The conductive layers 450A, 451A, 450B, and 451B may have a thickness $T_O$ that is greater that the thickness $T_1$ (FIG. 5). For instance, the thickness $T_O$ may be less than about 0.3 mm.

As used herein, an element or step recited in the singular and proceeded with the word "a" or "an" should be understood as not excluding plural of said elements or steps, unless such exclusion is explicitly stated. Furthermore, references to "one embodiment" or "an embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a connector housing having a mating face configured to engage a mating connector; and a contact module held by the connector housing and including differential pairs of signal conductors, the contact module also comprising:

dielectric ribs encasing corresponding signal conductors, the dielectric ribs being spaced apart from one another;

guard conductors extending between and coupling to adjacent dielectric ribs; and an ink-printed conductive layer disposed on the dielectric ribs and the guard conductors, the ink-printed conductive layer being electrically coupled to the guard conductors.

2. The electrical connector of claim 1, wherein the conductive layer has a thickness that is less than about 0.1 mm.

3. The electrical connector of claim 1, wherein the conductive layer extends continuously over the guard conductors and the dielectric ribs.

4. The electrical connector of claim 1, wherein the guard conductors comprise a guard material and the conductive layer comprises a layer material, the layer material having a lower electrical conductivity than the guard material.

5. The electrical connector of claim 1, wherein the contact module has a terminal end and a mounting end, the signal and guard conductors extending between respective conductor tails that are located at the terminal end and at the mounting end, the terminal and mounting ends facing in substantially perpendicular directions.

6. The electrical connector of claim 1, wherein the dielectric ribs include first dielectric ribs and second dielectric ribs that are discrete with respect to the first dielectric ribs, each of the first dielectric ribs surrounding a single corresponding signal conductor and each of the second dielectric ribs surrounding a single corresponding signal conductor, the first dielectric ribs being positioned adjacent to corresponding second dielectric ribs, the signal conductors of each of the adjacent first and second dielectric ribs forming one of the differential pairs.

7. The electrical connector of claim 1, wherein the conductive layer has a thickness that is less than about 0.01 mm.

8. The electrical connector of claim 1, wherein the dielectric ribs are coplanar and form a dielectric frame having first and second sides that face in opposite directions, the conductive layer being a first ink-printed conductive layer that extends along the first side of the dielectric frame, the contact module further comprising a separate second ink-printed conductive layer that extends along the second side of the dielectric frame.

9. The electrical connector of claim 1, wherein the dielectric frame, the guard conductors, and the first and second conductive layers constitute a module sub-assembly, the contact module comprising a pair of the module sub-assemblies that are stacked side-by side.

10. An electrical connector comprising:

a connector housing having a mating face configured to engage a mating connector; and a contact module held by the connector housing and including differential pairs of signal conductors, the contact module also comprising:

dielectric ribs encasing corresponding signal conductors, the dielectric ribs being spaced apart from one another;

guard conductors extending between and coupling to adjacent dielectric ribs; and a conductive layer disposed on the dielectric ribs and the guard conductors, the conductive layer being electrically coupled to the guard conductors;

wherein at least one of the differential pairs is completely surrounded by a shielding structure that includes a plurality of the conductive layers.

11. The electrical connector of claim 10, wherein the plurality of conductive layers are ink-printed along the dielectric ribs or overmolded onto the dielectric ribs.

12. An electrical connector comprising:

first and second module sub-assemblies stacked side-by-side, each of the first and second module sub-assemblies comprising:

signal and guard conductors;

a dielectric frame including dielectric ribs, the dielectric ribs encasing corresponding signal conductors, wherein the guard conductors extend between the dielectric ribs, the dielectric frame having an inner side and an opposite outer side; and a conductive layer disposed on the outer side of the corresponding dielectric frame such that the conductive layer extends along at least a pair of adjacent dielectric ribs of the corresponding dielectric frame and the corresponding guard conductor that extends between the pair of adjacent dielectric ribs, wherein conductive layer is rimed along outer side of the corresponding dielectric frame or overmolded onto the outer side of the corresponding dielectric frame, the conductive layer being electrically coupled to the corresponding guard conductor;

wherein the inner sides of the first and second module sub-assemblies engage each other, the signal and guard conductors of the first module sub-assembly coinciding with a first common plane and the signal and guard conductors of the second module sub-assembly coinciding with a second common plane that is spaced apart from the first common plane, the signal conductors of the first module sub-assembly being laterally aligned with corresponding signal conductors of the second module sub-assembly to form a plurality of differential pairs such that each differential pair includes one signal conductor from the first module sub-assembly and one signal conductor from the second module sub-assembly.

13. The electrical connector of claim 12, wherein the conductive layers are ink-printed along the outer sides of the corresponding dielectric frames.

14. The electrical connector of claim 12, wherein the conductive layers are overmolded onto the outer sides of the corresponding dielectric frames.

15. The electrical connector of claim 12, wherein the guard conductors and the conductive layers form a plurality of shielding structures, each of the shielding structures surrounding a corresponding differential pair.

16. An electrical connector comprising:

first and second module sub-assemblies stacked side-by-side, each of the first and second module sub-assemblies comprising:

signal and guard conductors:

a dielectric frame including dielectric ribs, the dielectric ribs encasing corresponding signal conductors, wherein the guard conductors extend between the dielectric ribs, the dielectric frame having an inner side and an opposite outer side; and a conductive layer disposed on the outer side of the dielectric frame such that the conductive layer extends along at least a pair of adjacent dielectric ribs and the corresponding guard conductor that extends between the pair of adjacent dielectric ribs, the conductive layer being electrically coupled to the corresponding guard conductor;

wherein the inner sides of the first and second module sub-assemblies engage each other, the signal and guard conductors of the first module sub-assembly coinciding with a first common plane and the signal and guard conductors of the second module sub-assembly coinciding with a second common plane that is spaced apart from the first common plane, the signal conductors of the first module sub-assembly being laterally aligned with corresponding signal conductors of the second module sub-assembly to form a plurality of differential pairs such that each differential pair includes one signal conductor from the first module sub-assembly and one signal conductor from the second module sub-assembly; and wherein the conductive layers are outer conductive layers, each of the first and second module sub-assemblies including an inner conductive layer disposed on the respective inner side of the corresponding dielectric frame.

17. The electrical connector of claim 16, wherein the inner sides of the dielectric frames of the first and second module sub-assemblies are shaped such that interior channels are formed when the first and second module sub-assemblies are stacked side-by-side, the interior channels being defined by the corresponding inner conductive layers.

18. The electrical connector of claim 16, wherein the inner and outer conductive layers are ink-printed or overmolded onto the corresponding dielectric frames.

19. The electrical connector of claim 16, wherein the inner conductive layer of each of the first and second module sub-assemblies extends along the pair of adjacent dielectric ribs of the corresponding dielectric frame and the guard conductor that extends between the pair of adjacent dielectric ribs.

20. The electrical connector of claim 19, wherein each of the differential pairs is surrounded by a shielding structure that includes the inner conductive layers and the outer conductive layers.

* * * * *